US008297089B2

(12) United States Patent
Walker

(10) Patent No.: US 8,297,089 B2
(45) Date of Patent: Oct. 30, 2012

(54) THEFT DETERRENT ENCLOSURE

(76) Inventor: Johnny Edward Walker, Gallatin, TN (US)

( * ) Notice: Subject to any disclaimer, the term of this patent is extended or adjusted under 35 U.S.C. 154(b) by 0 days.

(21) Appl. No.: 12/759,325

(22) Filed: Apr. 13, 2010

(65) Prior Publication Data

US 2010/0294674 A1 Nov. 25, 2010

Related U.S. Application Data

(60) Provisional application No. 61/180,148, filed on May 21, 2009.

(51) Int. Cl.
*B65D 55/14* (2006.01)

(52) U.S. Cl. ..... 70/160; 70/423; 70/427; 70/159; 70/158; 70/57; 70/140; 70/DIG. 57; 70/371; 70/63; 220/DIG. 25; 220/DIG. 27

(58) Field of Classification Search ..... 70/232, 70/160, 161, 57, 140, DIG. 57, 369, 371, 70/63, 159, 158, 423, 424, 427, 428; 220/DIG. 25, 220/DIG. 27
See application file for complete search history.

(56) References Cited

U.S. PATENT DOCUMENTS 1,700,799 A * 2/1929 Inglis et al. ..... 70/140
4,002,287 A * 1/1977 Saveth ..... 229/122.23
4,548,300 A * 10/1985 Sheill et al. ..... 188/73.1
4,777,812 A * 10/1988 Haugen ..... 70/232
6,006,556 A * 12/1999 Daoud ..... 70/56
6,139,075 A * 10/2000 Daoud ..... 292/281
2007/0228047 A1* 10/2007 Pehr et al. ..... 220/524
2009/0249843 A1* 10/2009 Ygnelzi et al. ..... 70/77

* cited by examiner

*Primary Examiner* — Suzanne Barrett
*Assistant Examiner* — David E Sosnowski
(74) *Attorney, Agent, or Firm* — Hornkohl Intellectual Property Law, PLLC; Jason L. Hornkohl

(57) ABSTRACT

A theft deterrent enclosure that eliminates unauthorized access is disclosed. The enclosure includes a door assembly having three sides and a wrapper assembly having three sides that mate to form a lockable enclosure. A key lock cylinder is mounted in a lock opening of the door assembly such that it blocks the lock opening in a locked position. A keyed interface operates a fastener, such as a compression latch, threaded coupling or lock plate, which is mounted on the door assembly such that the fastener secures the door assembly and the wrapper assembly in a closed position. The keyed interface is positioned on an interior side of the enclosure that is opposite and aligned with the lock opening. A guide sleeve is positioned inside the enclosure that guides a security keyed tool inserted through the lock opening toward the keyed interface. The theft deterrent enclosure can only be opened from a locked position by engaging the key lock cylinder with a key, removing the key lock cylinder tumbler, inserting the security keyed tool adapted to engage the keyed interface through the lock opening and disengaging the fastener.

12 Claims, 10 Drawing Sheets

THEFT DETERRENT ENCLOSURE

This is a Utility Patent Application filed for the invention by Johnny Edward Walker for a "Theft Deterrent Enclosure" that claims priority from U.S. Provisional Patent Application Ser. No. 61/180,148 filed May 21, 2009.

BACKGROUND OF THE INVENTION

1. Field of the Invention

The present invention relates generally to a new and improved tamper resistant enclosure. More particularly, this invention provides an enclosure for a cable service box that is easy for to service personnel to open and service but resistant to unauthorized access.

2. Description of the Prior Art

Prior art enclosures for protecting cable boxes and telephone lines have proven deficient in a number of respects. Cable television providers currently face many problems with the theft of components and other cable equipment that are mounted in open areas. In some areas, the theft of these types of components such as power supply boxes is a multi-million dollar industry. Cable providers face even more substantial losses of revenue through increased trouble calls, theft of services, theft of splitters, amplifiers, and signal leakage from cable boxes mounted to the exterior of residences. An unauthorized user may access the cable box of an authorized user and engage in signal splitting or other undesirable tampering. Components such as filters, taps, splitters, fittings and coaxial wire may also be stolen from these cable boxes and result in further losses to the cable provider. Such use not only results in lost revenue for the cable provider, but in addition may alienate the authorized user who endures reduced signal quality or service outages.

Signal leakage also results in adverse safety considerations. The Federal Communications Commission (FCC) and other regulatory agencies have mandated for example that signal leakage be reduced due to the negative effects on emergency communications such as those involving police, fire, aircraft, ham radio, security agencies, television and radio. Signal leakage could possibly disable the communications of safety services or aeronautical navigation systems. Such signal leakage is especially pronounced where not only has cable theft occurred, but the unauthorized users have cut some wires, loosely replaced others, or used cheap aftermarket splitters.

Enforcement after the fact is difficult for cable providers even though cable theft is a criminal offense in the United States under federal and state law. In theory, the federal Digital Millennium Copyright Act provides particularly stringent regulations against such behavior. However, in many cases, the only evidence left behind of such activities is in the possession of the valid users, and efforts to cut service to those utilizing splitters has an adverse effect on the valid user whose cable box has been accessed. Monitors have been utilized to detect theft and quickly address problems that occur, but these are expensive relative to their benefits.

As a result of the above discussed problems, it is desirable to provide cable housing boxes that prevent entry without detriment to the existing services. Cable providers across the country generally use either pad locks or a round inset lock that can be drilled through or knocked out, such that the lock is merely spinning around in the box and never locking the box itself. The locks also typically use a relatively expensive standardized key that has long since been duplicated to gain entrance to the enclosures. Due to the large number of enclosures and the costs of the locks, providers are reluctant to change the keys often. In addition, the enclosures typically have a housing that is easy to pry open or drill into and, thus, generally easy to break into. This leads to a situation where the enclosures are repeatedly vandalized and their contents accessed. The insecure nature of the prior art enclosures results in increased labor, material, repair and maintenance expenses and a culture of illegal access.

Prior art publications and patents have not addressed the above problems in a satisfactory manner. Many of the existing enclosures require substantial bending of cables entering or exiting the cable box, are difficult for authorized users such as technicians to access, or are prohibitively expensive to manufacture.

Therefore, what is needed is a theft deterrent cable housing box that provides easy access for an authorized user to the inside of the box while minimizing the likelihood of unauthorized access. It would further be desirable for such a device to be of relatively low cost and have easy access for cables passing to and from the box.

BRIEF SUMMARY OF THE INVENTION

The present invention provides a cable housing device for preventing cable box theft, minimizing signal leakage, reducing trouble calls, and providing an increase in customers. The device includes a double-locking mechanism that is relatively simple for authorized users having the proper tools to access. The device opens such that authorized users can easily work within the device once it is opened. In contrast, unauthorized users are substantially prevented from accessing the interior of the device. The device is of relatively low cost and requires minimal bending of cables entering into the interior of the box. The device is also easily mounted in any location in which such cable housing boxes are usually located.

More particularly, an embodiment of the present invention is directed toward a theft deterrent enclosure that has a two-piece housing. A first lock mechanism is mounted in a lock opening on the housing such that the first lock mechanism blocks the lock opening. The first lock mechanism can be removed from the lock opening using a key which mates with the first lock mechanism. A second lock mechanism is positioned in an interior of the enclosure such that the second lock mechanism is aligned with the lock opening and can be engaged with an elongated security keyed tool inserted through the lock opening.

The enclosure is preferably constructed from a door assembly having a door housing and a wrapper assembly having a wrapper housing that mates with the door assembly to form the enclosure. The first lock mechanism includes a key lock cylinder that is mounted in a lock opening in the door housing such that a tumbler in the key lock cylinder blocks the lock opening when the tumbler is locked in the key lock cylinder. The second lock mechanism includes a keyed interface that is mounted on the door housing such that the keyed interface engages a fastener, such as an offset nut, lock plate or compression latch, which secures the door assembly and the wrapper assembly in a closed position when the keyed interface is engaged with the security key tool. The keyed interface is positioned on an interior side of the enclosure opposite and aligned with the lock opening. A sleeve guide is positioned inside the enclosure, and in alignment with the lock opening and keyed interface, that guides the security keyed tool toward the keyed screw when the keyed tool is inserted through the lock opening.

The theft deterrent enclosure can be opened from a locked position by engaging the key lock cylinder with a key, removing the key lock cylinder from the lock opening, inserting a security keyed tool adapted to engage the keyed interface through the lock opening and disengaging the fastener.

Another embodiment of the invention is directed toward a device that includes a body having three sides and a lid having three sides. A pair of hinge blocks having set screws are mounted on the lid so that they can engage a hinge pin mounted on the body to removably and pivotally mount the lid on the body. When the lid pivots to engage the body in a closed position, the body and lid together form a box having a generally cubed or rectangular shape and six sides.

A first locking assembly is positioned on the lid that has a tumbler that can be unlocked and removed to expose an aperture in the lid. The locking assembly preferably has an anti-spin design and is made of stainless steel. As a result, an undesired entrant would require a long period of time and multiple drill bits to drill through the tumbler. The locking assembly is constructed so that even when the tumbler is removed in an unauthorized manner, steel fingers inside the lock obstruct the opening such that access to a second locking assembly is restricted.

The second locking assembly includes a guide bracket attached to the lid that has an aperture, a threaded fastener located in the guide bracket aperture, and a subassembly attached to the body that has a recessed portion that is threaded to receive the threaded fastener. The aperture and the recessed portion are aligned when the lid is in the closed position so that they define a channel aligned with the aperture in the lid. Thus, once the tumbler of the first locking mechanism is removed, a tool that is shaped and sized to fit through the channel and engage the fastener can be inserted through the lid aperture and channel to engage the fastener and unlock or lock the box. The fastener can use a lock plate, compression latch or threaded nut to securely hold the lid and wrapper together.

First and second locking tabs are preferably located on opposing ends of one side of the lid and first and second members are attached to opposing sides of the body. The members are shaped to receive the locking tabs when the lid is closed. These tabs and members secure the box housing from being bent or pried open from the outside. In addition, in conjunction with a hidden internal hinge connection, the tabs and member make the box very difficult to pry open or drill into.

DETAILED DESCRIPTION OF THE INVENTION

Figure 1C:
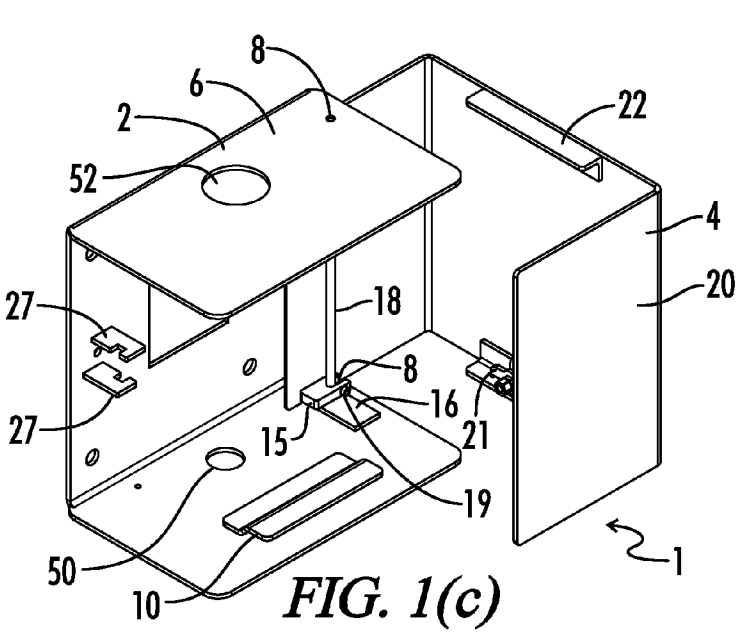
FIGS. 1(*a-d*) are mechanical drawings of top, isometric, side and front views of an embodiment of the present invention.
Figure 1D:
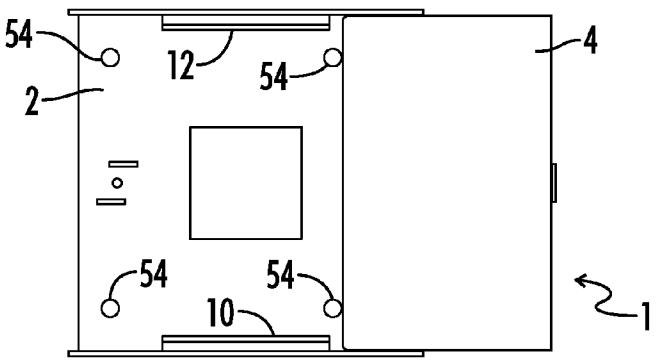
Figure 1A:
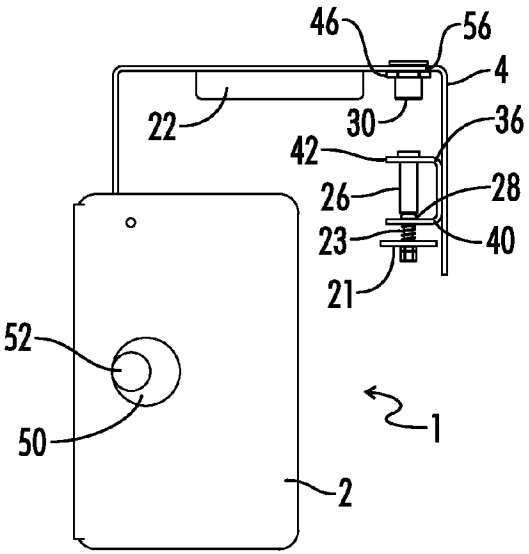
Figure 1B:
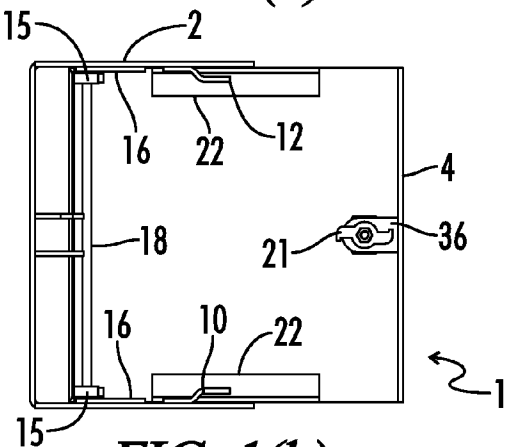
Figure 2C:
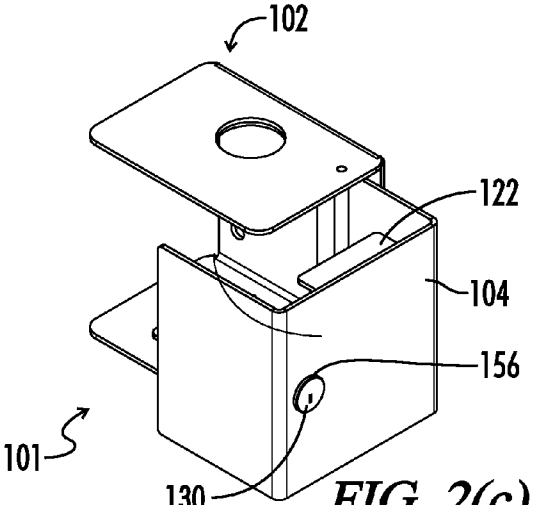
FIGS. 2(*a-d*) are mechanical drawings of a top, bottom, right side isometric and left side isometric views of a tamper resistant enclosure constructed in accordance with another embodiment of the present invention.
Figure 2D:
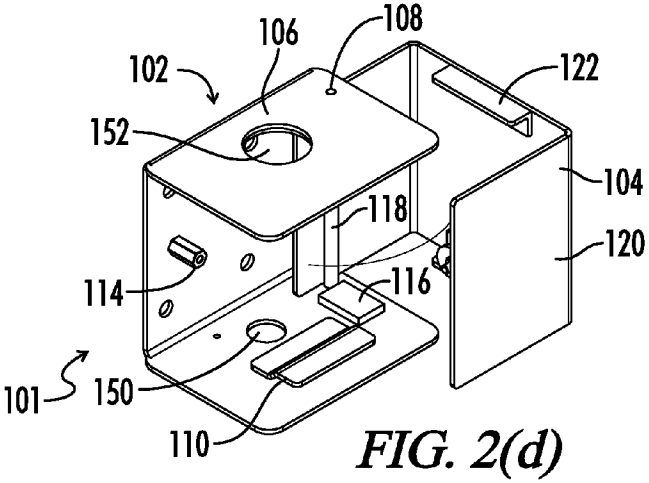
Figure 2A:
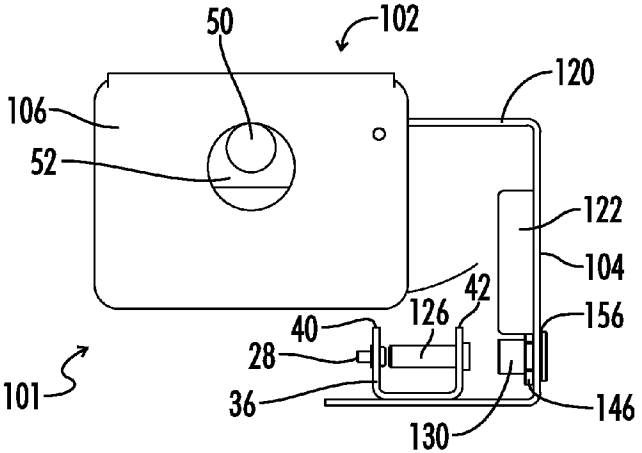
Figure 2B:
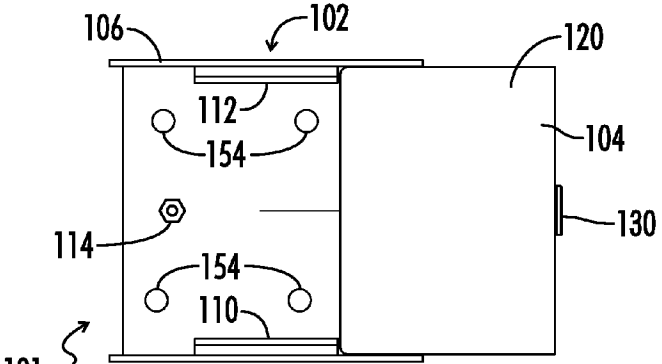

FIGS. 1(*a-d*) are top (*a*), isometric (*b*), side (*c*) and front views (*d*) of a preferred embodiment 1 of the present invention. The unique locking mechanisms and robust housing of the enclosure 1 shown reduce the risk of authorized access to the contents of the enclosure 1. The preferred embodiment shown in the figures consists of a wrapper assembly 2 and a door assembly 4. The wrapper assembly 2 includes a wrapper housing 6 and the door assembly 4 includes a door housing 20 which serve to mount the components of the assemblies 2 and 4 and protect the contents of the enclosure 1. The wrapper housing 6 and the door housing 20 are preferably constructed from stainless steel.

The door assembly 4 is pivotally connected to the wrapper assembly 2 with the pivotal attachment consisting of a pin 18 having two ends 8 affixed to the wrapper assembly 2 and a pair of hinge blocks 15 attached to the top and bottom of the door assembly. The hinge blocks 15 have slots that are dimensioned to receive the pin 18. Once the pin 18 is inserted into the slots of the hinge blocks 15, set screws 19 are inserted into threaded openings in the hinge blocks 15 to enclose the pin 18 within the hinge blocks 15 and pivotally and firmly secure the wrapper assembly 2 to the door assembly 4. The pin 18 is preferably welded to the wrapper assembly 2. To mount the door assembly 4 on the wrapper assembly 2, the pin 18 is inserted in the slits of the hinge blocks 15 and the set screws 19 screwed into enclose the pin 18 in the slits.

The enclosure 1 shown in the illustration is adapted to receive a cable from a cable service provider and provide a customer cable access at a customer location. Thus, the wrapper housing 6 has a lower opening 50 that is sized to receive the incoming cable from the cable service provider. The wrapper housing 6 also has an upper opening 52 that is adapted to provide access to the customer side cable. In the embodiment shown, the lower opening 50 is 1.375 inches in diameter and the upper opening 52 is 2.438 inches in diameter. The wrapper housing 6 also has attachment openings 54 that are adapted to receive screws used to mount the wrapper assembly 2 on a surface such as a wall or pole.

The door housing 20 of the enclosure 1 is preferably a U-shaped stainless steel metal member. The door housing 20 is used to mount the components of the door assembly 4 and protect the contents of the enclosure. The door housing 20 has a lock opening 56 that is dimensioned and positioned to receive a key lock cylinder 30 which is held in place against the door housing 20 with a lock cylinder nut 46. The key lock cylinder 30 can be a single unit that mates directly with the housing or a removable key cylinder in a separate lock sleeve that couples with the housing.

A small offset bar 10 and large offset bar 12 are attached to the wrapper housing 6. The small angles 22 of the door assembly 4 function in connection with the large 12 and small offset 10 bars of the wrapper assembly 2 to properly position the door assembly 4 with respect to the wrapper assembly 2 when the enclosure 1 is closed. The angles 22 and offsets 10 and 12 also function to brace the door assembly 4 and prevent it from moving with respect to the wrapper assembly 2, or being pried apart, when the enclosure 1 is closed and locked. The angles 22 and offsets 10 and 12 are preferably constructed from bent stainless steel.

A pair of flat bars 16 is also welded to the wrapper housing 6. The flat bars 16 serve to brace the wrapper assembly 2 and door assembly 4 when the enclosure is locked. The wrapper assembly 2 flat bars 16 have been positioned between the wrapper housing 6 and the hinge pin 18. Positioning the flat bars 16 in this manner further reinforces the hinge pin 18 and enclosure 1.

A U-bracket 36 has two legs 40 and 42 and is mounted on the door housing 20. The U-bracket 36 is preferably welded to the door housing 20 but may be attached in any suitable manner. A compression latch is formed from a pair of locking arms 21 coupled to a spring biased pin 23 that has a security keyed shaft head 28. The security keyed shaft head 28 is engaged through the lock opening with a security keyed tool once the key lock cylinder 30 has been removed. When the spring biased pin 23 is pressed with the security keyed tool and rotated with the door assembly 4 in a closed position with respect to the wrapper assembly 2, the locking arms 21 engage or disengage a pair of mating projections 27 mounted on the wrapper housing 6, preferably by welding. The mating projections 27 and locking arms 21 of the compression latch securely hold the door assembly 4 and wrapper assembly 2 in the closed position when engaged.

Referring to FIGS. 2(*a-d*), mechanical drawings of a top (*a*), bottom (*b*), right side isometric (*c*) and left side isometric (*d*) views of a tamper resistant enclosure 101 constructed in accordance with another embodiment of the present invention are shown. The individual parts of the preferred enclosure 101 of FIGS. 2(*a-d*) are shown in FIGS. 3-10 and the same reference numbers refer to the same parts throughout FIGS. 3-10.

Figure 3:
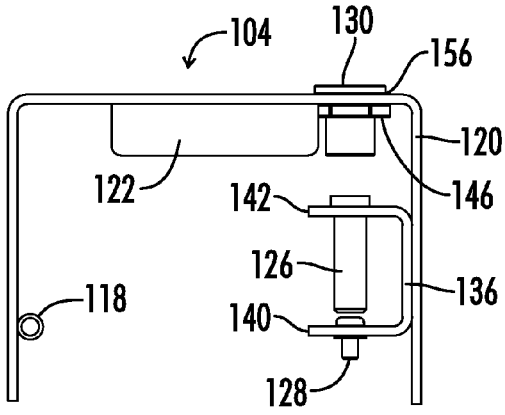
FIG. 3 is a mechanical drawing of a top view of the enclosure door assembly of FIG. 2.
Figure 4:
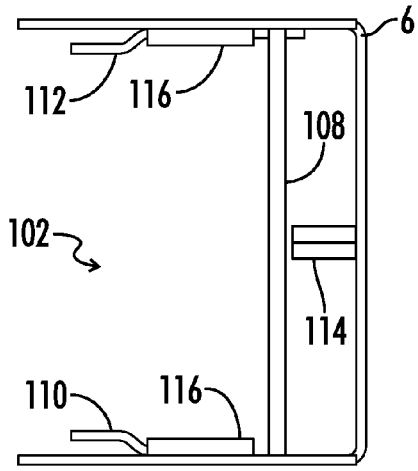
FIG. 4 is a mechanical drawing of a side view of the wrapper assembly of FIG. 2.
Figure 5:
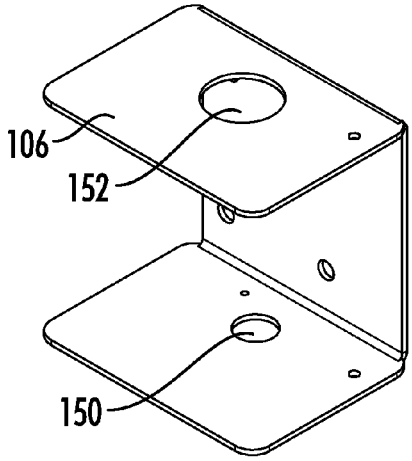
FIG. 5 is a mechanical drawing of the enclosure wrapper housing of FIG. 2.

Like the embodiment of FIG. 1, the embodiment shown in FIG. 2 consists of a wrapper assembly 102, FIG. 3, and a door assembly 104, FIG. 4. The wrapper assembly 102 includes a wrapper housing 106, FIG. 5, and the door assembly 104 includes a door housing 120, FIG. 7, which serve to mount the components of the assemblies 102 and 104 and protect the contents of the enclosure 101. The wrapper housing 106 and the door housing 120 are again preferably constructed from stainless steel.

Figure 9:
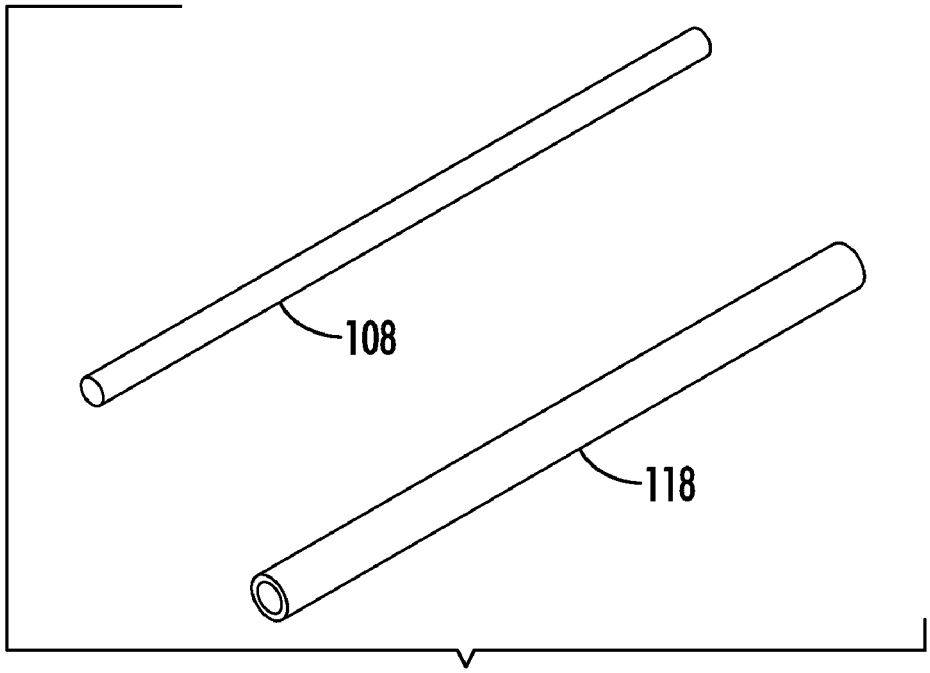
FIG. 9 is a mechanical drawing of the hinge tube and hinge pin of the tamper resistant enclosure of FIG. 2.
Figure 10:
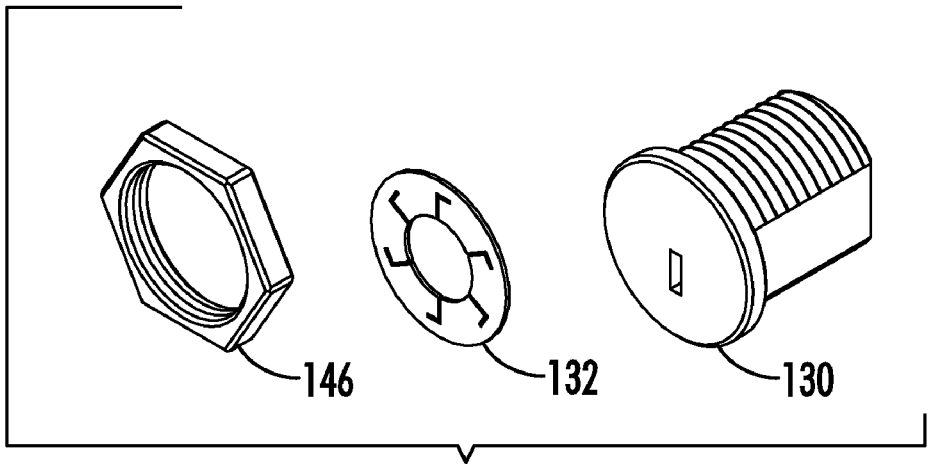
FIG. 10 is a mechanical drawing of the key lock cylinder, lock retainer washer, lock cylinder nut of the enclosure of FIG. 2.
Figure 11B:
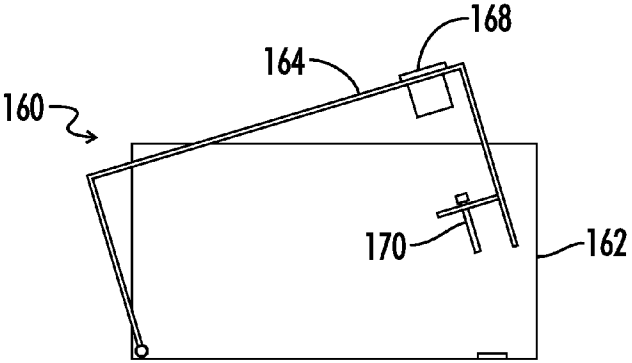
FIGS. 11(*a-d*) illustrate the opening and closing of an enclosure constructed in accordance with an embodiment of the present invention.
Figure 11D:
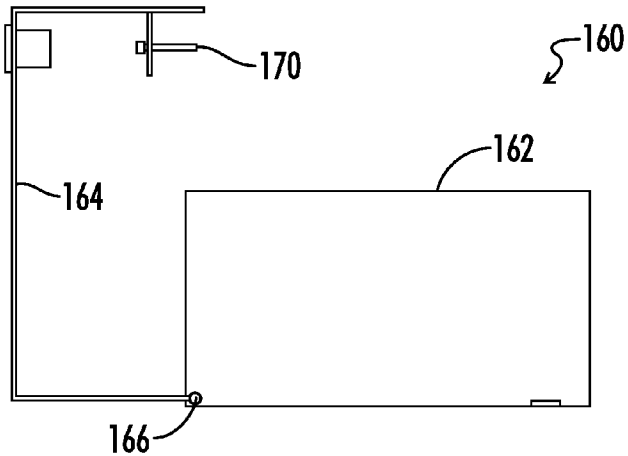
Figure 11A:
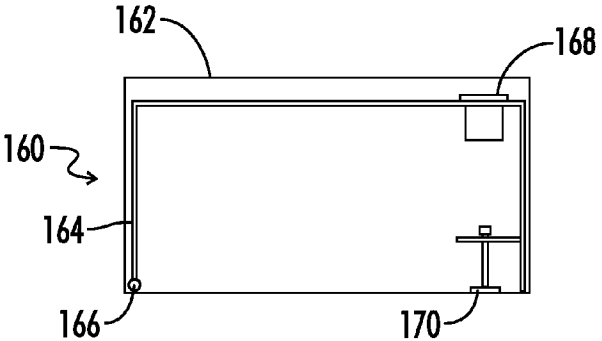
Figure 11C:
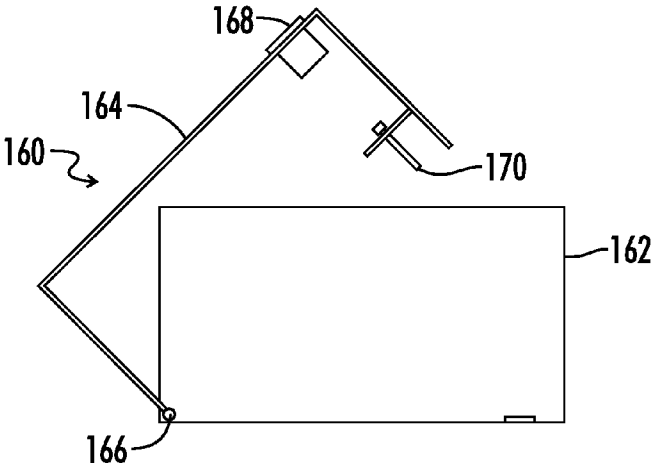
Figure 12:
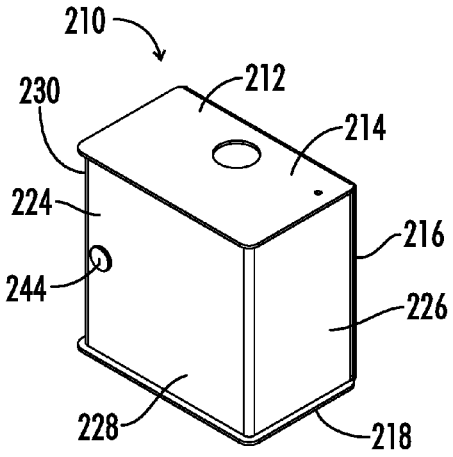
FIG. 12 is a mechanical drawing of the exterior of an enclosure in a closed position in accordance with an embodiment of the invention having a removable lid.
Figure 13:
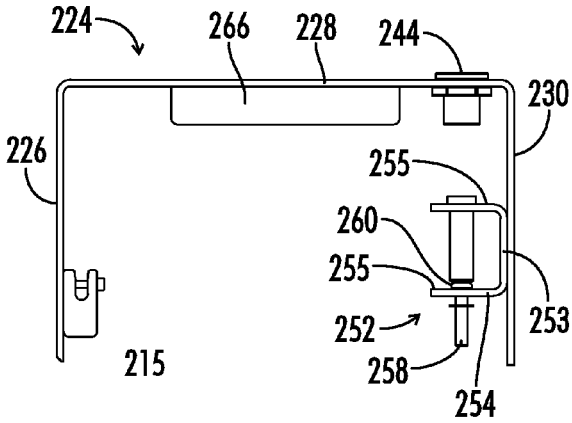
FIG. 13 is a mechanical drawing of the lid of the enclosure of FIG. 12.
Figure 14:
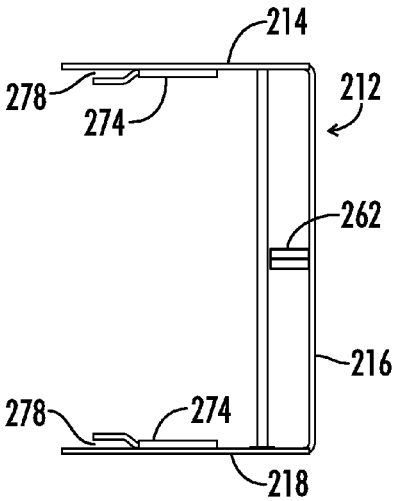
FIG. 14 is a mechanical drawing of the body of the enclosure of FIG. 12.
Figure 15:
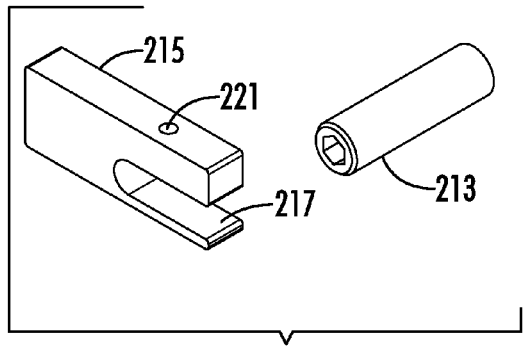
FIG. 15 is a mechanical drawing of the hinge block and hinge screw of the enclosure of FIG. 12.

In contrast to the embodiment of FIG. 1, the door assembly 104 of FIG. 2 is pivotally connected to the wrapper assembly 102 with a hinge pin 108 and a hinge tube 118, FIG. 9. The hinge tube 118 is preferably welded to the door assembly 104 housing 120. To mount the door assembly 104 on the wrapper assembly 102, the hinge pin 108 is inserted in the hinge tube 118, the wrapper assembly 102 moved into position with respect to the door assembly 104, and the ends of the hinge pin 108 welded to the wrapper assembly 102 housing 106 to permanently mount the door assembly 104 on the wrapper assembly 102. The hinge pin 108 and tube 118 are preferably constructed from stainless steel. The hinge tube 118 has an inner diameter slightly greater than the diameter of the pin 108 so as to engage the pin 108 but freely accommodate rotation of the pin 108 to open and close the door assembly 104. The hinge pin 108 and tube 118 are preferably attached by welding to the interior surfaces of the wrapper 106 and door housing 120 so that their attachment points are hidden from view to an observer on the outside of the enclosure 101 when the door assembly 104 is closed, thereby rendering the hinge mechanism substantially impossible to drill through or pry open.

The enclosure 101 shown in the illustration is adapted to receive a cable from a cable service provider and provide a customer cable access at a customer location. Thus, the wrapper housing 106 has a lower opening 150 that is sized to receive the incoming cable from the cable service provider. The wrapper housing 106 also has an upper opening 152 that is adapted to provide access to the customer side cable. The wrapper housing 106 also has attachment openings 154 that are adapted to receive screws used to mount the wrapper assembly 102 on a surface such as a wall or pole.

Figure 16:
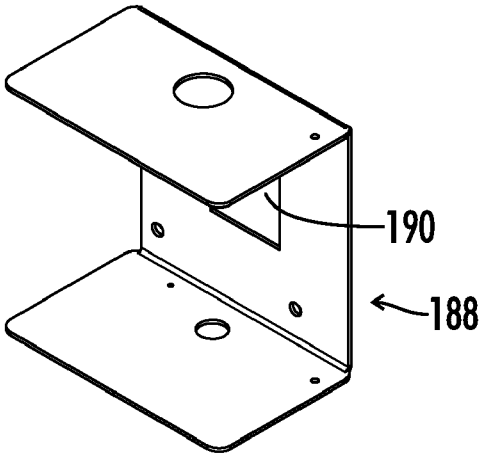
FIG. 16 is a mechanical drawing of an alternative wrapper housing.

An alternative wrapper housing 188 is shown in FIG. 16 that has a square shaped access opening 190 that can be used to mount the wrapper housing 188. The enclosure 101 shown is designed and dimensioned to contain the standard components required for providing cable service. However, the dimensions of the openings 150 and 152 and the enclosure housing 106 and 120 can easily be altered to the requirements of any particular application as desired while still retaining the beneficial aspects of the design.

Figure 17:
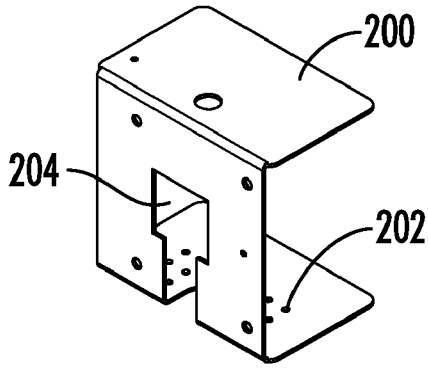
FIG. 17 is a mechanical drawing of another alternative wrapper housing.

Yet another alternative wrapper housing 200 is shown in FIG. 17. The wrapper housing has a series of access holes 202 formed in the bottom of the wrapper housing 200 that allow cable providers to provide access to the box to other service providers such as telephone companies. Barrel connectors connected to the appropriate lines are placed inside the access holes 202 so other providers can gain access to the needed services, but not the inside of the enclosure. This prevents the regrettable, but not uncommon, practice of competitive service providers tearing up competitors services so that customers will consider the new providers service. The present invention keeps third party service providers out of the enclosure while providing access to the service. The wrapper housing 200 of FIG. 17 also differs from the previously discussed embodiments in that it has an enlarged opening 204 in the back and bottom of the housing. This allows a cable tap to be inserted through the back of the enclosure box which minimizes the need for splicing and resplicing.

Figure 7:
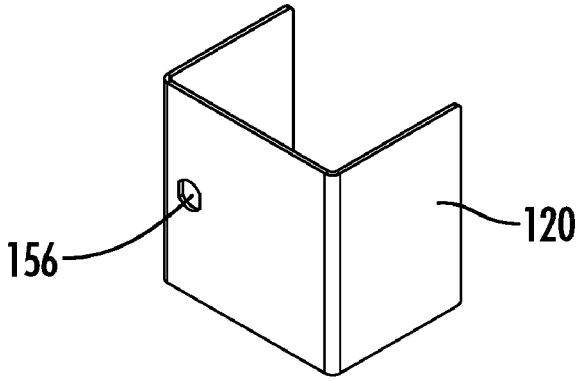
FIG. 7 is a mechanical drawing of the door housing of the tamper resistant enclosure wrapper assembly of FIG. 2.

The door housing 120 of the enclosure 101 is preferably a U-shaped stainless steel metal member, FIG. 7. The door housing 120 is used to mount the components of the door assembly 104 and protect the contents of the enclosure. The door housing 120 has a lock opening 156 that is dimensioned and positioned to receive a key lock cylinder 130 which is held in place against the door housing 120 with a lock cylinder nut 146, FIG. 10. The key lock cylinder 130 can be a single unit that mates directly with the housing or a removable key cylinder in a separate lock sleeve that couples with the housing.

Figure 6:
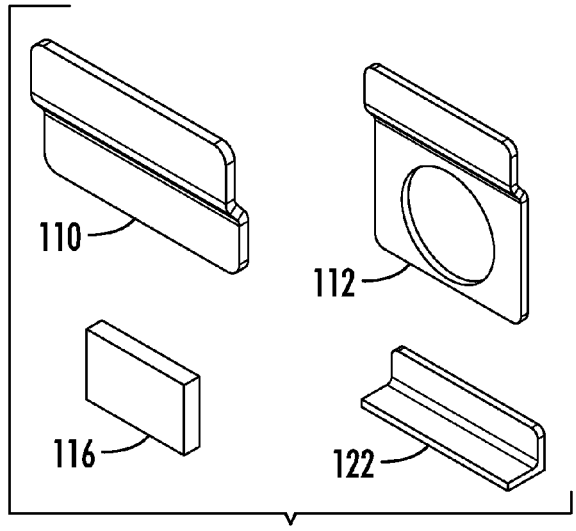
FIG. 6 is a mechanical drawing of the small offset, large offset, angle member and flat bar of the tamper resistant enclosure of FIG. 2.

A small offset bar 110 and large offset bar 112, FIG. 6, are attached to the wrapper housing 106. The small angles 122, FIG. 6, of the door assembly 104 function in connection with the large 112 and small offset 110 bars of the wrapper assembly 102 to properly position the door assembly 104 with respect to the wrapper assembly 102 when the enclosure 101 is closed. The angles 122 and offsets 110 and 112 also function to brace the door assembly 104 and prevent it from moving with respect to the wrapper assembly 102, or being pried apart, when the enclosure 101 is closed and locked.

Figure 18:
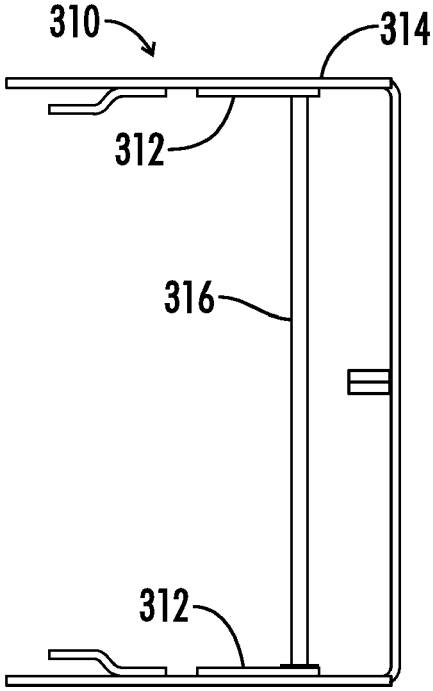
FIG. 18 is a mechanical drawing showing an alternative placement of the flat bars on the wrapper assembly.
Figure 19A:
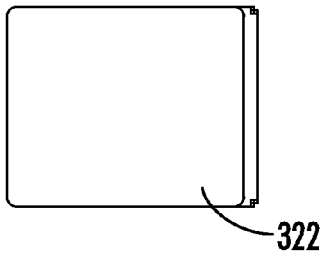
FIGS. 19(*a-d*) are illustrations of an embodiment of the present invention adapted to be mounted on a pedestal.
Figure 19D:
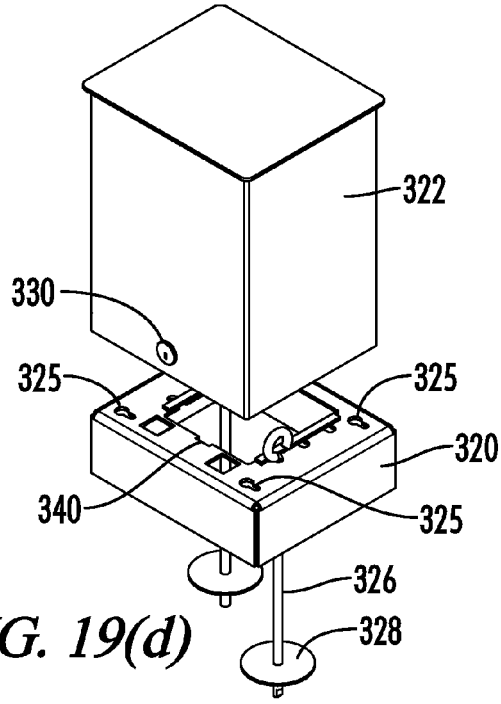
Figure 19B:
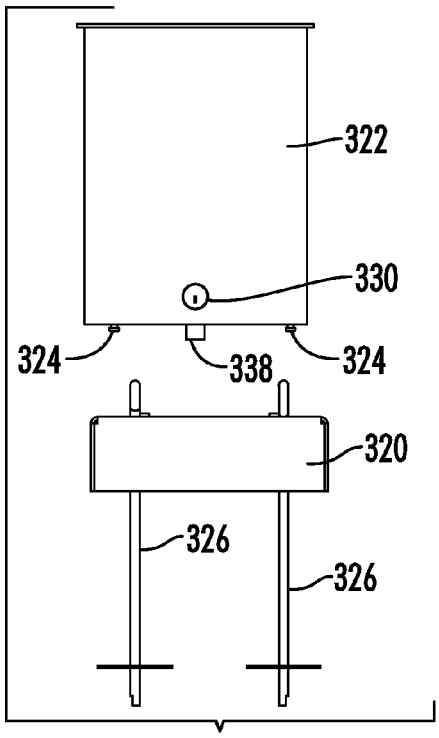
Figure 19C:
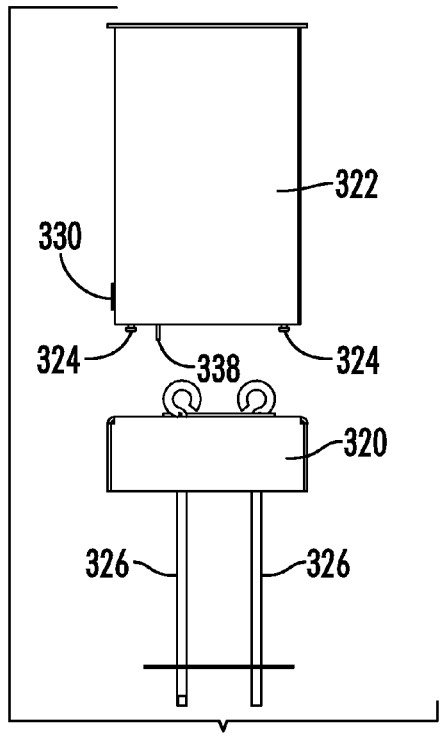

A pair of flat bars 116, FIG. 6, is also welded to the wrapper housing 106. The flat bars 116 also serve to further brace the wrapper assembly 102 and door assembly 104 when the enclosure is locked. An alternative embodiment of the wrapper assembly is shown in FIG. 18. The wrapper assembly 310 differs from the wrapper assembly 102 of FIG. 2 in that the flat bars 312 have been positioned between the wrapper body 314 and the hinge 316. Positioning the flat bars 312 in this manner further reinforces the hinge 316 and enclosure.

Figure 8:
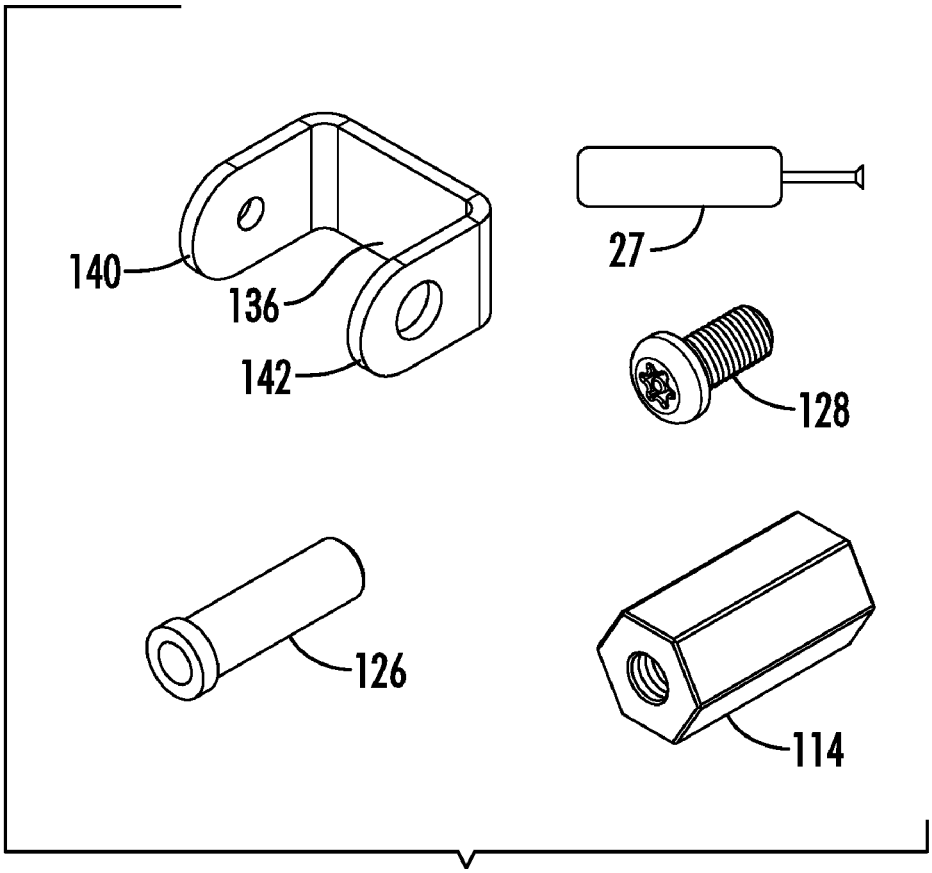
FIG. 8 is a mechanical drawing of the U-bracket, lock guide sleeve, keyed lock screw, security keyed tool and offset nut of the tamper resistant enclosure of FIG. 2.

The U-bracket 136, FIG. 8, has two legs 140 and 142 and is mounted on the door housing 120. One leg 142 of the U-bracket 136 has an opening or aperture that is used to mount the lock guide sleeve 126 to the door housing 120. The other leg 140 of the U-bracket 136 has an opening that receives a special keyed lock screw 128, FIG. 8, which has a head that is designed to mate with a similarly keyed screw driver 127. A screw retainer washer 132 holds the keyed lock screw 128 on the bracket leg 140. The keyed lock screw 128 mates with an offset nut 114 which serves to firmly couple the door assembly 104 to the wrapper assembly 102 when the enclosure is locked as described in more detail herein. While a U-bracket 136 is used in the embodiment shown to mount the lock screw 128 and guide sleeve 126, alternative means such as individual mounts can be used.

To open the enclosure 101, a user must first remove the key lock cylinder 130 from the lock opening 156 using a corresponding key. Once the lock in the key lock cylinder 130 is released, the key lock cylinder 130 is removed from the opening in the door housing 120. However, once the key lock cylinder 130 is removed, the door assembly is still firmly held against the wrapper assembly by the keyed lock screws 28 engagement with the offset nut 114 which is mounted on the wrapper assembly 102. To open the enclosure, the user must remove the keyed lock screw 128 after opening the key lock cylinder 130. Thus, if the key lock cylinder 130 is removed by an unauthorized user, the enclosure 101 will still be locked and the second locking means will not be visible.

The lock guide sleeve 126, FIG. 8, is used to guide a keyed screw driver to a special lock screw 128 so that the keyed screw driver can be inserted through the lock opening and the lock sleeve guide 126 to engage the special keyed lock screw 128 which has a head that is designed to mate with a similarly keyed screw driver. The keyed screw 128 can be easily altered and replaced to foil dedicated violators that obtain any particular keyed tool.

FIGS. 11(*a-d*) illustrate the opening and closing of a cable housing device constructed in accordance with an embodiment of the present invention. The enclosure 160 consists of a body 162 and a lid 164 which are pivotally attached by a hinge 166. FIG. 11(*a*) shows a top view of the enclosure 160 in a closed position with the lid 164 coupled to the body 162 by the first 168 and second 170 locking mechanisms. FIG. 11(*b*) shows a top view of the enclosure 160 in a ⅓rd open position with the lid 164 pivoting with respect to the body 162 on the hinge 166 and the first 168 and second 170 locking mechanisms unlocked. FIG. 11(*c*) shows the enclosure 160 in a ⅔rds open position. FIG. 11(*d*) shows the enclosure 160 in the fully open position which allows complete access to the components in the body 162 and positions the locking mechanisms 168 and 170 out of the way.

Referring now to FIGS. 12-15, another embodiment of the present invention is shown. The device 210 includes a body 212 having first, second and third sides 214, 216, 218. In the embodiment shown, the first and third sides 214, 218 extend perpendicular from opposing ends 220, 222 of the second side 216. The three sides may be integrally formed from a single material and bent into shape, or may be formed separately and attached by welding for example.

The device further includes a lid 224 having first, second and third sides 226, 228, 230. The first and third sides 226, 230 extend perpendicular from opposing ends 232, 234 of the second side 228. The lid 224 in various embodiments generally has smaller dimensions than the body 212 but may be substantially similar in shape and size such that together they form a box having six sides, the second side 228 of the lid 224 opposing the second side 216 of the base 212 when the box is in a closed position.

The lid 224 is pivotally attached to the base 212, with the pivotal attachment consisting of a pin 236 having two ends 238 affixed to the first and third sides 214, 218 of the body 212, and a pair of hinge blocks 215 attached to the top and bottom of the first side 226 of the lid 224. The hinge blocks 215 have slots 217 that are dimensioned to receive the pin 236. Once the pin is inserted into the slots 217 of the hinge blocks 215, set screws 219 are inserted into the threaded openings 221 in the hinge blocks 215 to enclose the pin 213 within the hinge blocks and pivotally and firmly secure the lid 224 to the base 212. The use of hinge blocks 215 to mount the lid 224 on the base 212 may be preferred over the welded construction of FIG. 2 in that it allows the lid 224 to be easily removed from the base 212 for maintenance or replacement in the field without the need for welding equipment.

In the embodiment of FIGS. 12-15, the second side 228 of the lid 224 may also be referred to as the front 228, or face 228, of the device 210. The first and third sides 214, 218 of the body 212 may also be referred to as the top 214 and bottom 218 of the device 210 respectively. In alternative embodiments, the front, top and bottom of the device 210 may be configured differently and the references herein with respect to these terms is not intended as limiting but merely as locational references to assist the reader.

In manner similar to the embodiment of FIG. 2, a first locking mechanism 244 is positioned on the second side 228 of the lid 224. The first locking mechanism 244 has an anti-spin design and includes a first locking mechanism 244 with a removable tumbler centrally located to the locking mechanism 244. The tumbler is removable from the lock 244 when it is turned with a tumbler key provided to a user as discussed above. The tumbler key is preferably a specially made key that is intended for use only with the lock 244 or others of similar design. Upon removal of the tumbler from the locking mechanism 244, an aperture is formed in the second side 228 of the lid 224 that permits access by a user to the inside of the closed box 210. In an alternative embodiment, the first locking assembly 244 further can include steel fingers positioned inside the first locking mechanism that engage when the tumbler of the locking mechanism 244 has been improperly removed to make unauthorized access to the box much more difficult.

A second locking mechanism 252 provides additional protection to improper opening of the box. The second locking mechanism 252 includes a guide bracket 254 attached to the third side 230 of the lid 224. The guide bracket 254 may be integrally formed with the third side 230 of the lid 224, but otherwise is attached to the lid 224 by means such as welding or equivalents well known in the art. The guide bracket 254 has a base 253 attached to the lid 224 and two arms 255 extending from the third side 230 of the lid 224, each arm 255 has an aperture substantially aligned with the aperture in the second side 228 of the lid 224 when the lid 224 is in a closed position.

A threaded fastener 258 is positioned in one the arms 255 of the guide bracket 254. In the embodiment shown, the fastener 258 consists of a stainless steel specialty screw 258 having a head 260 facing the aperture in the second side 228 of the lid 224, but various equivalent fasteners 258 may be substituted. The head 260 of the fastener 258 is shaped and sized to receive a special tool provided to the user as discussed above. The user may insert the special tool through the aperture in the second side 228 of the lid 224 after properly removing the tumbler from the locking mechanism 244 and engage the screw 258 to lock or unlock the second locking assembly in place on a subassembly 262 attached to the second side 216 of the body 212 and having a recessed portion threaded to receive the threaded fastener 258 or specialty screw 258. The recessed portion in embodiments as shown is generally aligned with the aperture of the guide bracket 254.

A pair of locking tabs 266 is located on opposing ends of the second side 228 of the lid 224. A pair of mating grove members 274 is attached to the first and third sides 214, 218 of the body 212 that define grooves 278. The mating groove members 274 are shaped so as to receive the locking tabs 266 within the defined grooves 278 when the lid 224 is in a closed position with respect to the body 212. This combination further secures the device 210 from being flexed, bent or otherwise pried open from the top or from the bottom of the outside of the device 210, as such activities merely reinforce the positioning of the tabs 266 within the grooves 278.

FIGS. 19(*a-d*) are illustrations of a top (*a*), front (*b*), isometric (*c*) and side (*d*) views of an embodiment of the present invention adapted to be mounted on a pedestal 320 secured to the ground. The pedestal 320 is attached to the enclosure body 322 with protrusions 324 on the body that mate with shaped openings 325 on the pedestal. To attach the body 322 to the pedestal 324, the protrusions 324 are inserted into the openings 325 and the body 322 moved right with respect to the pedestal 324 so that the protrusions 324 engage the openings 325 thereby holding the enclosure together. The pedestal 320 is secured to the ground with augers 326 having retaining washers 328 that grasp the ground.

Figure 20A:
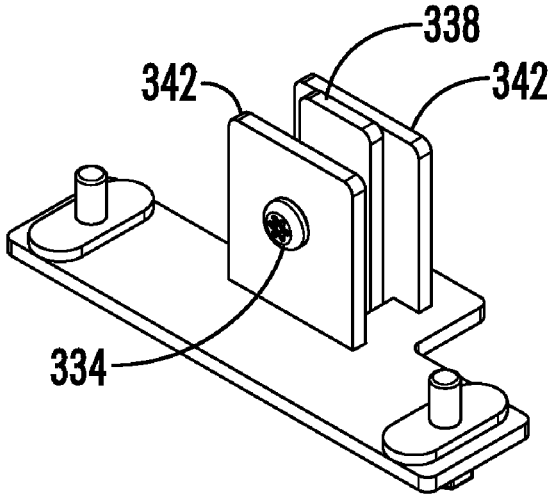
FIGS. 20 (*a*) and (*b*) are isometric and side views of a second locking assembly system modified for use with the pedestal mounted embodiment of FIG. 19.
Figure 20B:
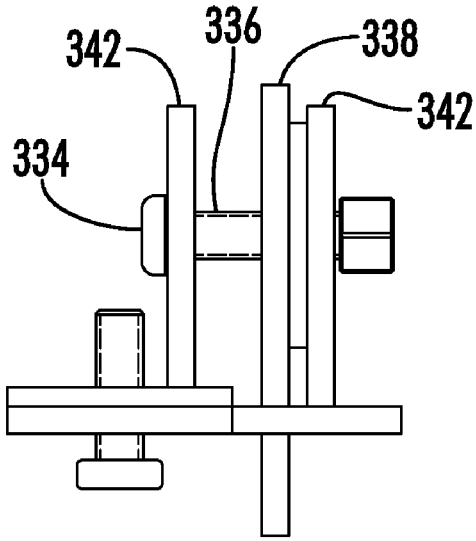

The embodiment of FIGS. 19(*a-d*) uses a two lock system modified to accommodate the lid on a pedestal mounted enclosure body. To open the enclosure, the lock cylinder 330 is removed from the lock opening 332 in the same manner as described above. Once the lock cylinder 330 is removed, the keyed head 334 of the threaded shaft 336 of the second lock mechanism can be accessed through the lock opening 332 as before. However, in this embodiment, the second lock mechanism uses a lock plate 338 as shown in FIGS. 20(*a*) and (*b*). The keyed threaded shaft 336 is mounted on two guide plates 342 connected to the enclosure body 322. Rotation of the keyed threaded shaft 336 causes a lock plate 338 mounted on the shaft 336 between the guide plates 342 to move forward and backward and engage and disengage a locking slot 340 formed in the front of the pedestal 320. Once the lock plate 338 is disengaged from the lock slot 340, the protrusions 324 can be disengaged from the openings 325 and the body 322 removed from the pedestal 320. Since the embodiment of FIGS. 19 and 20 is operated in the substantially the same manner as the previously discussed embodiments, it can be operated by personnel in the same manner, with the same tool, without much regard to the particular construction of the lock assembly.

It is to be understood that the present invention is not explicitly limited to the embodiment illustrated in the detailed description given above. Various changes and modifications may be made to Theft Deterrent Enclosure without departing from the spirit and scope of the invention as defined in the following claim.

What is claimed is:

1. A theft deterrent enclosure comprising:

a door assembly having a door housing;

a wrapper assembly having a wrapper housing that mates with said door assembly to form an enclosure;

a key lock cylinder mounted in a lock opening of said door housing such that said key lock cylinder blocks said lock opening when said key lock cylinder is in a locked position; and a keyed interface mounted on said door housing and positioned on an interior side of said enclosure opposite said key lock cylinder such that said keyed interface is aligned with said lock opening and said key lock cylinder and such that said keyed interface engages a mating member mounted on said wrapper housing to secure said door assembly and said wrapper assembly in a closed position when said keyed interface is engaged with said mating member;

wherein said theft deterrent enclosure can be opened from a locked position by engaging said key lock cylinder with a key, removing said key lock cylinder from said lock opening, inserting a security keyed tool adapted to engage said keyed interface through said lock opening and disengaging said keyed interface from said mating member.

2. The theft deterrent enclosure of claim 1 wherein said keyed interface further comprises a threaded shaft and said mating member further comprises and offset nut.

3. The theft deterrent enclosure of claim 1 further comprising a sleeve guide positioned inside said enclosure that guides said keyed tool toward said keyed screw.

4. The theft deterrent enclosure of claim 1 further comprising a hinge pin and hinge blocks for detachably and pivotally mounting said door assembly on said wrapper assembly.

5. A theft deterrent enclosure comprising:

a housing;

a first lock mechanism mounted in a lock opening on said housing such that said first lock mechanism blocks said lock opening wherein said first lock mechanism can be removed from said opening using a key that mates with said first lock mechanism; and a second lock mechanism positioned in an interior of said enclosure such that said second lock mechanism is aligned with said first lock mechanism and said lock opening and said second lock mechanism can be engaged with an elongated security key tool inserted through said lock opening.

6. The enclosure of claim 5 wherein said housing further comprises a lid that mates with a body.

7. The enclosure of claim 6 further comprising at least one offset member positioned on said body that mates with at least one angle on said lid.

8. An enclosure comprising:

a rotating lock mechanism mounted in a lock opening of a housing of said enclosure such that said rotating lock mechanism blocks said lock opening when said lock mechanism is locked; and a rotating coupling member positioned inside said enclosure that holds said enclosure in a closed position wherein said rotating coupling member is only accessible by removing said lock mechanism from said lock opening;

wherein a rotational axis of said rotating lock mechanism is aligned with a rotational axis of said rotating coupling member.

9. The enclosure of claim 8 wherein said coupling member further comprises a keyed interface.

10. The enclosure of claim 8 wherein said housing further comprises a U-shaped wrapper housing that mates with a U-shaped door housing to form an exterior of said enclosure.

11. The enclosure 10 further comprising at least one offset positioned on said wrapper housing that mates with an angle on said door housing to brace said wrapper housing with respect to said door housing in a closed position.

12. The enclosure of 8 wherein said housing further comprises a lid and a body attached with a hinge pin and at least one hinge block.

* * * * *